United States Patent [19]

Herfurth

[11] Patent Number: 5,005,768

[45] Date of Patent: Apr. 9, 1991

[54] SPRAY NOZZLE

[75] Inventor: Eike Herfurth, Allensbach, Fed. Rep. of Germany

[73] Assignee: Elkem a/s, Norway

[21] Appl. No.: 533,462

[22] Filed: Jun. 5, 1990

[30] Foreign Application Priority Data

Jun. 29, 1989 [NO] Norway ..... 892,706

[51] Int. Cl.[5] ..... B28C 7/16; B28C 7/12; E04F 21/12

[52] U.S. Cl. ..... 239/417; 239/427.3

[58] Field of Search ..... 239/417, 427, 427.3, 239/429, 430, 431, 433, 434, 600

[56] References Cited

U.S. PATENT DOCUMENTS 2,124,989 7/1938 Smith .
2,543,517 2/1951 Anderson .

FOREIGN PATENT DOCUMENTS 3408007 5/1985 Fed. Rep. of Germany .
83/04213 12/1983 PCT Int'l Appl. .
87/01648 3/1987 World Int. Prop. O. .

*Primary Examiner*—Andres Kashnikow
*Assistant Examiner*—Lesley Morris
*Attorney, Agent, or Firm*—Lucas & Just

[57] ABSTRACT

A spray nozzle for dry shotcreting is disclosed. The spray nozzle has a first member through which dry concrete mix is passed, a second member attached to the first member through which water is passed, and a spray nozzle head. The spray nozzle head has a plurality of openings for water inlet from the second member into the dry concrete mix which passes into the spray nozzle head from the first member. The openings are arranged either circularly or helically about the circumference of the spray nozzle head. The number of openings available for water inlet can be adjusted by axial movement of the spray nozzle head.

8 Claims, 1 Drawing Sheet

SPRAY NOZZLE

Figure 1:
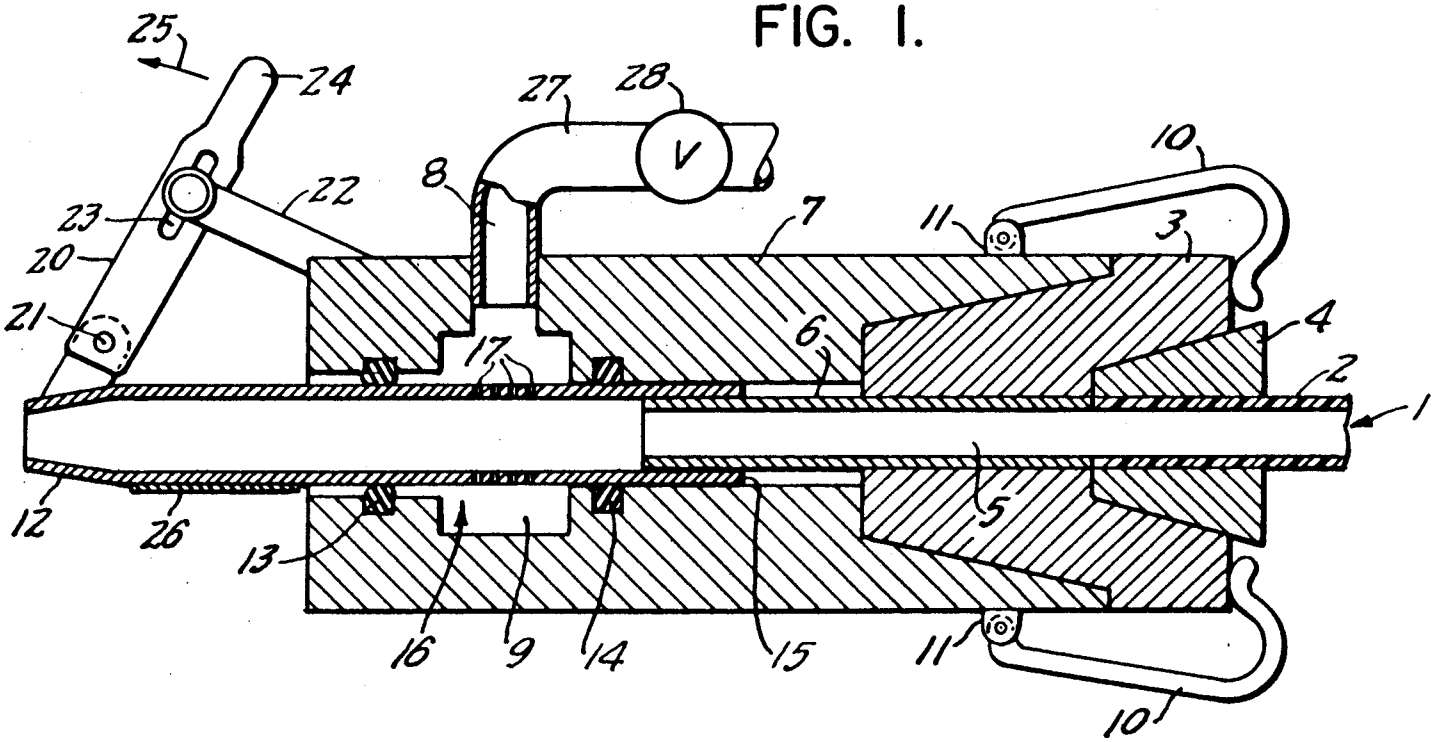

The present invention relates to a spray nozzle for dry shotcreting said nozzle having inlet opening for dry mix of cement and aggregate and an inlet opening for water supply.

In the dry shotcreting process the dry concrete mix is mixed with water in the spray nozzle where the water is introduced into the nozzle through a water ring having a plurality openings for spraying a water curtain in front of the dry mix which is projected through the nozzle. It is important that the amount of water to the amount of dry mix is closely controlled in order to get the correct ratio of water to cement in the final concrete.

Normally the amount of water is controlled by the use of a valve in the water pipe running to the water ring. This, however, has the disadvantage that by reducing the amount of water, the velocity of the water flowing through the openings in the water ring is also reduced. This may lead to a non-homogeneous mixing of water and the dry mix in the nozzle resulting in a poor quality of the final concrete.

From PCT patent application No. WO 87/01648 a spray nozzle is disclosed whereby it is possible to adjust the openings in the water ring. The openings in the water ring are inclined towards the longitudinal axis of the water ring and are arranged in a regular manner around the circumference of the water ring. These openings in the water ring can be regulated while the speed of the water remains essentially unchanged. This nozzle has, however, a number of drawbacks and disadvantages. Thus the arrangement for adjusting the openings in the water ring is rather complicated. Further as the longitudinal slots in the water ring are adjusted in a continuous way, it is difficult to obtain a correct amount of water passing through the water ring. Finally, it is difficult to demount the nozzle when it is necessary to clean the nozzle.

It is an object of the present invention to provide a spray nozzle for dry shotcreting having an inlet opening for dry concrete mix and which nozzle is simple to mount and demount and where the water supply can be regulated in discrete steps during the shotcreting operation while the velocity of the water remains essentially unchanged.

Accordingly the present invention relates to a spray nozzle for dry shotcreting having an inlet opening for dry concrete mix and an inlet opening for water which inlet opening can be regulated without effecting the velocity of the water, said spray nozzle comprising a first member having an axial bore and means for firmly affixing a hose for transport of dry concrete mix to the first member, a removable pipe inserted into the first member, a second member having an axial bore, an inlet opening for water and a water chamber, a spray nozzle head inserted into the axial opening in the second member, sealing means arranged between the spray nozzle head and each side of the water chamber, a sealing means between the removable pipe and the spray nozzle head, said spray nozzle head being axially movably connected to the second member by connecting means, said spray nozzle head being equipped with a plurality of openings axially spaced apart and arranged about the circumference of the spray nozzle head whereby the number of openings in the spray nozzle head located inside the area of the water ring can be adjusted by axial movement of the spray nozzle head.

According to a preferred embodiment of the present invention the second member is releasably connected to the first member by means of two clips which are connected to the outer periphery of the second member.

According to a first embodiment the openings in the spray nozzle head are arranged with a plurality of openings equally spaced apart about the circumference of the spray nozzle head and located in a plane perpendicular to the longitudinal axis of the spray nozzle head and with a further plurality of openings arranged equally spaced apart and located at a helical line running about the spray nozzle head.

According to a second embodiment the openings in the spray nozzle head are arranged in a plurality of series of openings which series are axially spaced apart and located in planes perpendicular to the longitudinal axis of the spray nozzle head and aranged about the circumference of the spray nozzle head.

The openings for water in the spray nozzle head are arranged at an angle between 30° and 90° with respect to the longitudinal axis of the spray nozzle head and in the direction of the flow of dry material.

The spray nozzle according to the present invention is very simple and reliable. Thus the nozzle consists of only a few pieces which can be demounted simply by releasing the clips which are used for connection of the second member to the first member.

The water delivered to the spray nozzle can be regulated during the shotcreting process by axial movement of the spray nozzle head, whereby the number of water openings located in the area of the water chamber can be adjusted. The water openings in the spray nozzle head, which are moved out of the area of the water ring will not be available for the water flow and by choosing the number of water openings available for water flow through the water chamber the amount of water can be accurately regulated. The closed water openings in the spray nozzle head will be safely protected against clogging by means of the sealing means between the spray nozzle head and the second member.

Figure 2:
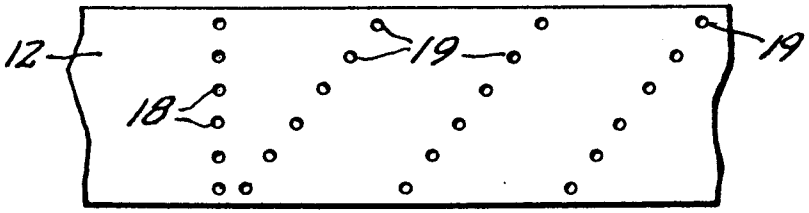

An embodiment of the present invention will now be further described in connection with the accompanying drawings in which, FIG. 1 shows a cross-section through the spray nozzle according to the present invention, and FIG. 2 shows part of the spray nozzle head axially cut and folded out showing a preferred arrangement of the openings in the spray nozzle head.

In FIG. 1 there is shown a spray nozzle comprising an inlet end 1 for dry mix. The inlet end 1 comprises a hose 2 for transporting the dry concrete mix from a silo or bin (not shown on the figure) by means of pressurized air. The hose 2 is connnected to a first member 3 by means of cone 4. By pressing the cone 4 into the space between the first member 3 and the hose 2, the hose 2 is fixed to the first member 3 in a simple and reliable way. In a central opening 5 in the first member 3 there is inserted a pipe 6 extending out of the first member 3. The pipe 6 can easily be changed with pipes having a different inner diameter. To the first member 3 there is connected a second member 7 having a water supply inlet opening 8 and a cylindrical water chamber 9. The second member 7 is connected to the first member 3 with a connection means consisting of two clips 10 which are pivotably connected to the outer periphery of the second member 7 at 11. A spray nozzle head 12 is inserted into a front opening in the second member 7 and is sealed off from the second member 7 by means of rubber bellows 13 and 14 arranged on each side of the water chamber 9 in the second member 7. The rear end 15 of the spray nozzle head 12 is fitted on the outside of the pipe 6, the inner diameter of the spray nozzle head being approximately identical to the outer diameter of the pipe 6. The connection between the spray nozzle head and the pipe 6 is preferably sealed by grease or by a rubber bellow (not shown). The spray nozzle head 12 has a plurality of axially spaced apart water openings 16.

According to the embodiment shown in FIG. 1 the water openings 16 in the spray nozzle head 12 are arranged in four series 17 of openings where the series are axially spaced apart and each series 17 of openings being arranged about the circumference of the spray nozzle head 12 in planes perpendicular to the longitudinal axis of the spray nozzle head 12.

According to the embodiment shown in FIG. 2 a first series 18 of water openings are aranged about the circumference of the spray nozzle head 12 and located in a plane perpendicular to the longitudinal axis of the spray nozzle head 12. A plurality of further water openings 19 are arranged on a helical line running about the spray nozzle head. The first series 18 of water opening is arranged nearest the front of the spray nozzle head. The first series 18 of water openings will always be present inside the water chamber 9 while the number of the helically arranged openings 19 placed inside the water chamber 9 can be adjusted in order to regulate the water flow.

The spray nozzle head 12 is adjustably connected to the second member 7 by connecting means comprising of a first arm 20 pivotably connected to the spray nozzle head 12 at 21 and a second arm 22 pivotably fixed in a slot 23 in the first arm 20 and pivotably fixed to the second member 7. By moving the upper end 24 of the first arm 20 the spray nozzle head 12 is moved axially in relation to the second member 7. It is thereby possible to regulate the number of water openings 16 which are located inside the water chamber 9 in the second member 7. In FIG. 1 the nozzle spray head 12 is shown in a position where all the water openings 16 are inside the water chamber 9. By moving the upper end 24 of the first arm 20 in the direction indicated by the arrow 25, the spray nozzle head 12 will be moved axially inside the first member 7 and the water openings 16 will thereby successively pass behind the rubber bellow 14 and thus no water will pass through the water openings 16 which have passed behind the rubber bellow 14. By adjusting the number of water openings 16 which are located inside the water chamber 9, the amount of water delivered to the spray nozzle head 12 is regulated. This regulation can be made during the shotcreting operation. In order to control the amount of water passing into the dry mix for a certain water pressure, or the number of water openings located inside the water chamber 9, a scale 26 is arranged on the spray nozzle head 12.

To the inlet opening 8 for water in the second member 7 there is connected a water pipe 27 equipped with an on-off valve 28. The valve 28 is only used for closing and opening the water supply and not to regulate the supply.

The water opening 16 in the spray nozzle head are arranged at an angle between 30° to 90° with respect to the longitudinal axis of the spray nozzle head and in the direction of the flow of material. This is so that the stream of water penetrates well into the material before being destroyed by the flowing dry material in the air stream.

As described above and shown on the figure, the complete spray nozzle is kept together by the two clips 10. Thus the spray nozzle of the present invention is extremely easy to mount and demount.

As can be seen from the drawing the internal diameter of the spray nozzle head is enlarged in the area where the water is added. Due to this enlargement of the diameter from the pipe 6 to the spray nozzle head 12, the material stream opens up in the area where water is added and thereby permits a better penetration of water into the dry shotcrete mix.

What is claimed:

1. A spray nozzle for dry shotcreting having an inlet opening (1) for dry concrete mix and an inlet opening (8) for water which inlet opening can be regulated without effecting the velocity of the water, characterized in that the spray nozzle comprises a first member (3) having an axial bore, means (4) for firmly affixing a hose (2) for transport of dry concrete mix to the first number (3), a removable pipe (6) inserted into the first member (3), a second member (7) having an axial bore, an inlet opening for water (8) and a water chamber (9), a spray nozzle head (1) inserted into the axial opening in the second member (7), sealing means (13,14) arranged between the spray nozzle head (12) and each side of the water chamber (9), said spray nozzle head (12) being axially movably connected to the second member (7) by connecting means (20, 21, 22, 23), said spray nozzle head (12) being equipped with a plurality of openings (16) axially spaced apart and arranged about the circumference of the spray nozzle head (12), whereby the number of openings (16) in the spray nozzle head (12) located inside the area of the water chamber (9) can be adjusted by axial movement of the spray nozzle head (12).

2. Spray nozzle according to claim 1, characterized in that the opening (16) in the spray nozzle head are arranged with a plurality of openings (16), spaced apart about the circumference of the spray nozzle head (12) and located in a plane perpendicular to the longitudinal axis of the spray nozzle head (12) and with a further plurality of openings (16) arranged spaced apart and located at a helical line running about the spray nozzle head (12).

3. Spray nozzle according to claim 1, characterized in that the openings (16) in the spray nozzle head (12) are arranged in a plurality of series (17) which series (17) are axially spaced apart and located in planes perpendicular to the longitudinal axis of the spray nozzle head (12).

4. Spray nozzle according to claim 1, characterized in that the second member (7) is releasably connected to the first member (3) by means of clips (10).

5. Spray nozzle according to claim 1, characterized in that the sealing means (13, 14) comprises rubber bellows or O-rings.

6. Spray nozzle according to claim 1, characterized in that the means for connecting the spray nozzle head (12) to the second member (7) comprises a first arm (20) pivotably affixed to the spray nozzle head (12) and a second arm (22) pivotably affixed at one end in a slot (23) in the first arm (20) and at the other end pivotably affixed to the second member (7).

7. Spray nozzle according to claim 1, characterized in that means (4) for connecting the hose (2) to the first member (3) is a cone (4).

8. Spray nozzle according to claim 1, characterized in that the openings (16) in the spray nozzle head (12) are arranged at an angle to the longitudinal axis of the spray nozzle head (12) of between 30° and 90° seen in the direction of flow of concrete mix.

* * * * *

UNITED STATES PATENT AND TRADEMARK OFFICE

CERTIFICATE OF CORRECTION

PATENT NO. : 5,005,768

DATED : April 9, 1991

INVENTOR(S) : Eike Herfurth

It is certified that error appears in the above-identified patent and that said Letters Patent is hereby corrected as shown below:

Column 1, line 11, after "plurality" insert --of--.

Column 1, line 50, change "effecting" to --affecting--.

Column 2, line 33, after "head" delete ",".

Column 3, line 19, change "aranged" to --arranged--.

Column 3, line 62, change "opening" to --openings--.

Column 4, line 16, change "effecting" to --affecting--.

Column 4, line 19, change "number" to --member--.

Column 4, line 23, change "head (1)" to --head (12)--.

Column 4, line 35, change "opening (16)" to --openings (16)--.

Column 4, line 37, after "openings (16)" delete ",".

Signed and Sealed this

Eighth Day of September, 1992

*Attest:*

DOUGLAS B. COMER

*Attesting Officer*

*Acting Commissioner of Patents and Trademarks*